US007996921B1

(12) United States Patent
Snyder

(10) Patent No.: US 7,996,921 B1
(45) Date of Patent: Aug. 16, 2011

(54) FISHING VEST/CHEST PACK WITH BACK STORAGE

(76) Inventor: Joshua Alexander Snyder, Erie, PA (US)

( * ) Notice: Subject to any disclaimer, the term of this patent is extended or adjusted under 35 U.S.C. 154(b) by 586 days.

(21) Appl. No.: 12/150,209

(22) Filed: Apr. 24, 2008

(51) Int. Cl.
*A41D 13/00* (2006.01)

(52) U.S. Cl. ..... 2/102

(58) Field of Classification Search ..... 2/94, 102, 2/108, 69, 2.5, 247, 462; 224/581, 631, 637, 224/582, 158, 638
See application file for complete search history.

(56) References Cited

U.S. PATENT DOCUMENTS 5,657,917 A * 8/1997 Johnson et al. ..... 224/582
5,799,851 A * 9/1998 Wulf et al. ..... 224/583
7,681,769 B2 * 3/2010 Kramer ..... 224/581

* cited by examiner

*Primary Examiner* — Tejash Patel
(74) *Attorney, Agent, or Firm* — Richard K Thomson

(57) ABSTRACT

A fishing vest/chest pack has a backpack slidably attached to its shoulder straps to enable the backpack to be flipped between a first stored position and a second in front position enabling ready access to the contents of the backpack without the need to remove the garment.

12 Claims, 3 Drawing Sheets

FISHING VEST/CHEST PACK WITH BACK STORAGE

BACKGROUND AND SUMMARY OF THE INVENTION

The present invention is directed to the field of fishing equipment/apparel. More particularly, the present invention is directed to a fishing vest which has an auxiliary backpack storage compartment which can be flipped over one's shoulder for easier access to the contents.

Fishing continues to grow in popularity resulting in a proliferation of fishing tackle, togs and other equipment. Still, there is not a functional fishing vest with backpack storage that can be easily accessed without the need for removing the garment. As a result, a fisherman, whether s/he is fishing in a stream, pond or ocean, wading, fishing from a bank or boat, must stop what s/he is doing, remove the vest or backpack to access a snack, lunch or additional garment that is being stored behind her/him. This results in significant "wasted time" and potential "ones that got away". Virtually all fishermen would rather have opportunities to catch fish than opportunities to construct fish stories. Accordingly, it is an object of this invention to provide a fishing vest with a readily accessible backpack portion that makes it quick and easy to get at the contents thereof without the need for removing the garment.

The fishing vest/chest pack of the present invention, therefore, includes at least one front storage compartment; a first strap extending over a first shoulder of a wearer of the fishing vest upon which the at least one front storage compartment is mounted; a second strap extending over a second shoulder of the wearer of the fishing vest upon which the at least one front storage compartment is mounted; a back storage compartment housing contents, the back storage compartment having a first stowed position riding on a back portion of the wearer of the fishing vest; mounting means securing the back storage compartment to the first and second straps, the mounting means permitting the back storage compartment to be flipped to a second position in front of the wearer of the fishing vest; whereby the wearer of the vest may move the back storage compartment from its first stowed position to its second position to access the contents of the back storage compartment without removing the vest. Preferably, the mounting means comprises a pair of D-rings affixed to the back storage compartment, one each of the pair of D-rings slidably surrounding one of the first and second straps. In one embodiment, the at least one storage compartment comprises two pockets, one each on a left and a right panel of the vest.

The mounting means preferably comprises a pair of strap lengths attached to the backpack compartment. In addition, the mounting means further comprises a D-ring secured to a distal end of each of the strap lengths, each D-ring having a spring clip secured thereto. The spring clips releasably attach to a second pair of D-rings that are each slidably received on one of the first and second shoulder straps, respectively.

In a second preferred embodiment, the device further comprises a neck harness interconnecting the first shoulder strap with the second shoulder strap. The front storage compartment comprises a chest pack attached to the first and second shoulder straps. A torso strap releasably attached to end portions of said chest pack.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
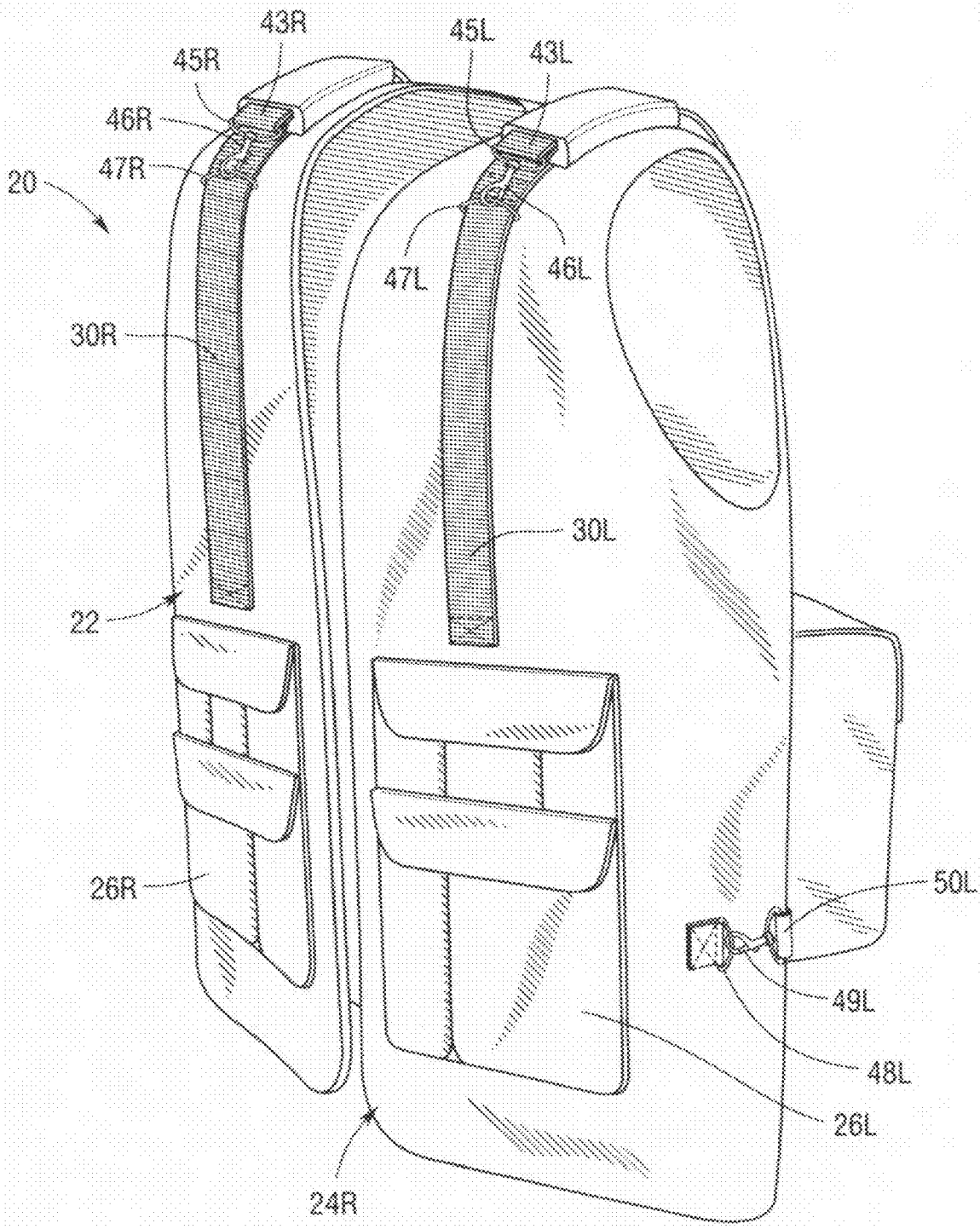
FIG. 1 is a perspective front view of a first embodiment of the fishing vest of the present invention.
Figure 2:
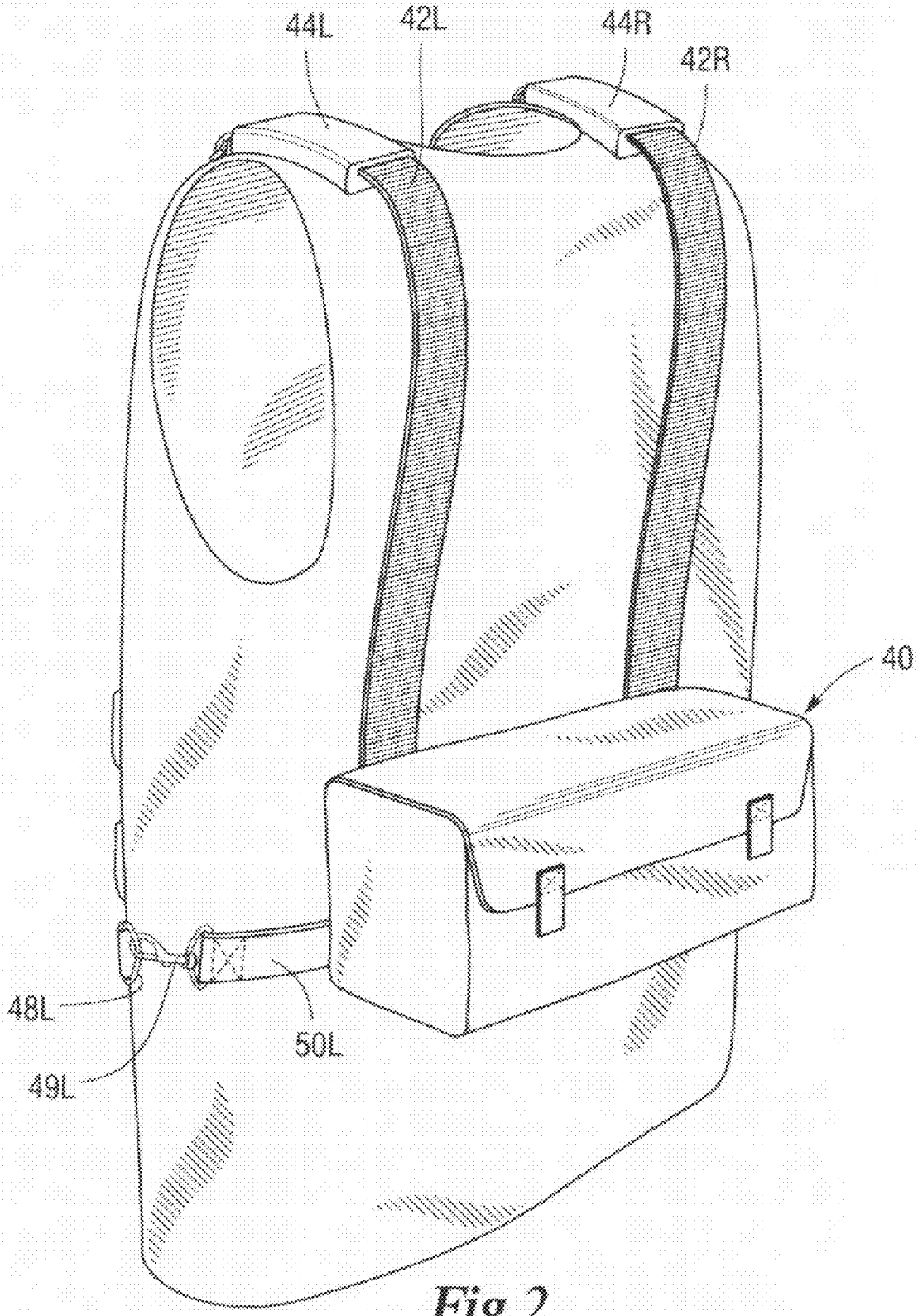
FIG. 2 is a perspective rear view of the first embodiment.

A first embodiment of the fishing vest/chest pack of the present invention is depicted in FIGS. 1 and 2 generally at 20. For the ease of reference, the term "fishing vest" is defined as including "chest pack". The fishing vest 20 is constructed as a conventional garment having a right front panel 22 and a left front panel 24, each panel having at least one storage compartment in the form of pockets 26R and 26L. First shoulder strap 30R is secured to right front panel 22 and second shoulder strap 30L is secured to left front panel 24 as by stitching, although it will be appreciated that other securement means could be used, as well.

A backpack compartment 40 has strap lengths 42R and 42L (FIG. 2) secured thereto, again, by stitching. Strap lengths 42R and 42L have foam padding sections 44R and 44L slidably mounted thereon, respectively, for the comfort of the wearer. The distal ends 43R and 43L are each doubled over and stitched around a D-ring 45R and 45L, respectively. Each D-ring 45 has a spring clip 46R and 46L attached thereto which releasably engages a second pair of D-rings 47R and 47L which are slidably mounted on first and second shoulder straps 30R, 30L, respectively. Short strap lengths 50 (50L being shown) are stitched to backpack 40 and attach to D-rings 48 (48L being shown) via spring clips 49 to secure backpack 40 against bouncing. By unclipping spring clips 49 and sliding D-rings 47R, 47L downwardly on straps 30R, 30L, backpack compartment 40 can be brought to a position behind the neck of the wearer where it may be easily grasped and swung overhead to a position in front such that the wearer may access the contents. Obviously, the wearer may place anything s/he wants in compartment 40. However, normally, fishing equipment will be placed in the front pockets 26R, 26L while compartment 40 will be reserved for food items, a drink, additional clothing items, a camera, etc.

Figure 3:
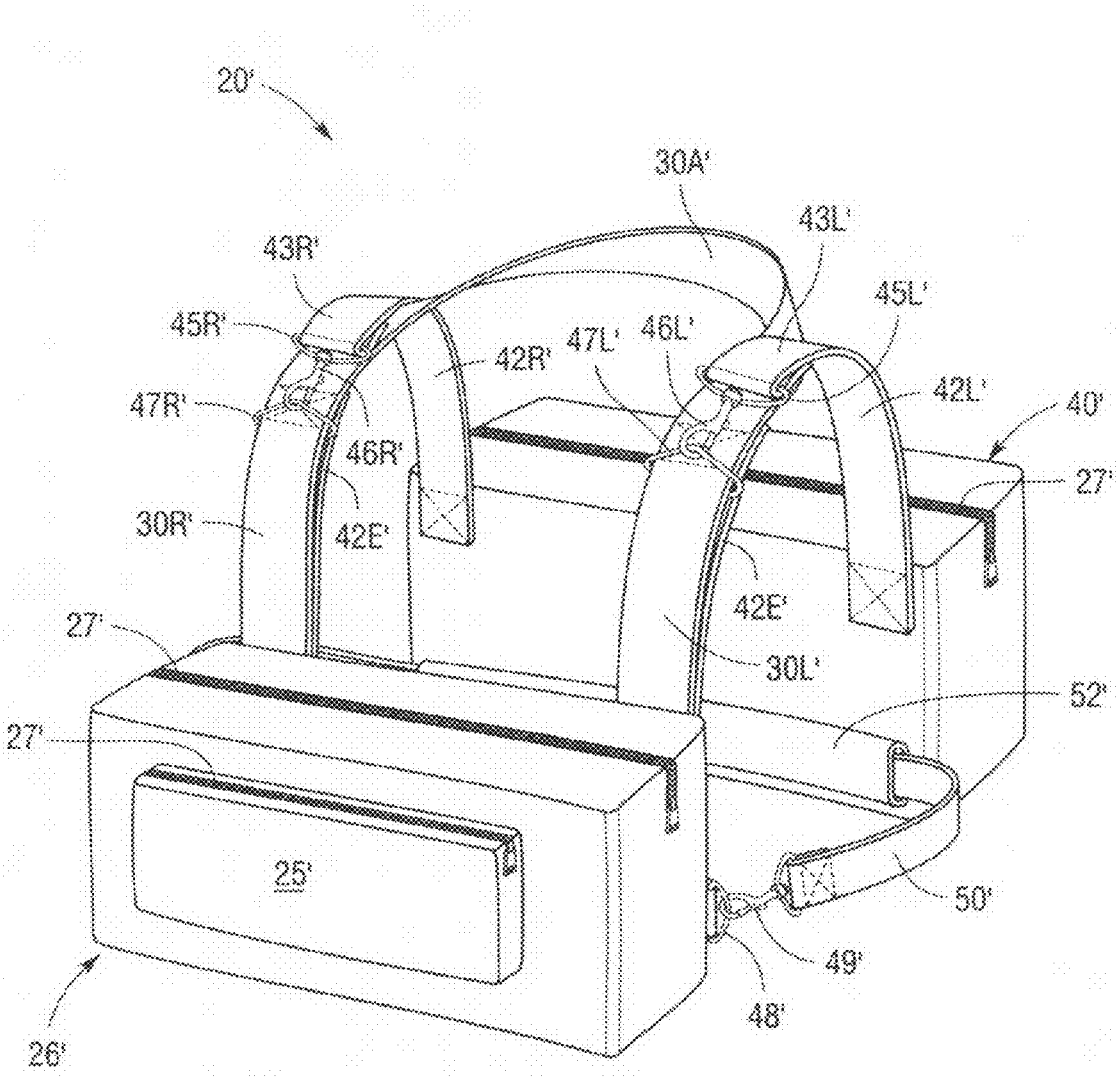
FIG. 3 is a perspective front view of a second embodiment of the fishing vest of the present invention.

A second embodiment, which is actually preferred for its simplicity, is shown in FIG. 3 generally at 20'. Fishing vest 20' comprises a front storage compartment 26' essentially configured as a chest pack which is equipped with an auxiliary compartment 25', each having a waterproof zipper 27'. Shoulder strap 30R' is interconnected to shoulder strap 30L' by a neck harness 30A' which sits behind the wearer's neck. Backpack compartment 40' has a pair of strap lengths 42R' and 42L' attached thereto as by stitching. As in the previous embodiment, distal ends 43W and 43L' are each doubled over and stitched around a D-ring 45R' and 45L', respectively. Each D-ring 45' has a spring clip 46W and 46L' attached thereto which releasably engages a second pair of D-rings 47W and 47L' which are slidably mounted on first and second shoulder straps 30R', 30L', respectively. The movement of D-rings 45' is limited by a second strap length 42E' stitched to the undersurface of each shoulder strap 30R', 30L' in order to prevent backpack compartment 40' from sagging backwardly.

While none of the straps are shown as being adjustable, obviously any/all of them could employ conventional means to adjust their lengths to accommodate various size wearers. A torso strap 50' loops through a sleeve 52' and is attached to a pair of D-rings 48' (one shown) secured to each end of front storage compartment 26' by spring clips 49'. Sleeve 52' can be attached to backpack compartment 40' by, stitching, by Velcro® fabric, or not at all, without adversely affecting the operation of fishing vest 20'. If the attachment is effected by Velcro® fabric, access to compartment 40' will be achieved by simply disengaging the Velcro® fabric strips on the compartment 40' from those on sleeve 52'. If sleeve is stitched to compartment 52', spring clips 49' can be disengaged from D-rings 48' and compartment 40' flipped overhead as in the previous embodiment. If there is no attachment between sleeve 52' and compartment 40', the latter will merely ride upon the former with the compartment being flipped overhead whenever desired.

Either embodiment of fishing vest 20, 20' enable the backpack compartment 40, 40' to be readily accessed by the wearer without the need for removing the garment. This may be done quickly and easily without risking the "big one" swimming by while our fisherman has taken a lengthy break to remove his fishing vest in order to gain access to the backpack compartment 40, 40'. Spring clips 46, 46' enable the backpack compartment 40, 40' to be removed when the specific occasion does not require its use.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A fishing vest comprising a) at least one front storage compartment;

b) a first shoulder strap extending over a first shoulder of a wearer of said fishing vest upon which said at least one front storage compartment is mounted;

c) a second shoulder strap extending over a second shoulder of the wearer of said fishing vest upon which said at least one front storage compartment is mounted;

d) a back storage compartment housing contents, said back storage compartment having a first stowed position riding on a back portion of the wearer of said fishing vest;

e) mounting means securing said back storage compartment to said first and second shoulder straps, said mounting means permitting said back storage compartment to be flipped to a second position in front of the wearer of said fishing vest;

f) securement means preventing said first and second shoulder straps from being removed when said back storage compartment is flipped to said second position;

whereby the wearer of said fishing vest may move said back storage compartment from its first stowed position to its second position to access the contents of said back storage compartment without removing said fishing vest.

2. The fishing vest of claim 1 wherein said mounting means comprises a pair of D-rings affixed to said back storage compartment, one each of said pair of D-rings slidably surrounding one of said first and second straps.

3. The fishing vest of claim 1 wherein said at least one storage compartment comprises two pockets, one each on a left front panel and a right front panel of said fishing vest.

4. The fishing vest of claim 3 wherein said mounting means comprises a pair of strap lengths attached to said backpack compartment.

5. The fishing vest of claim 4 wherein said mounting means further comprises a D-ring secured to a distal end of each of said strap lengths, each said D-ring having a spring clip secured thereto.

6. The fishing vest of claim 5 wherein said mounting means further comprises a second pair of D-rings to which one of each of said spring clips is attached, one of each of said second pair of D-rings being slidably received on one of said first and second shoulder straps, respectively.

7. The fishing vest of claim 6 further comprising a pair of short straps connected to said backpack, each said short strap having means to secure said short strap to a waist portion of one of said front panels.

8. The fishing vest of claim 1 further comprising a neck harness interconnecting said first shoulder strap with said second shoulder strap.

9. The fishing vest of claim 8 further comprising a chest pack attached to said first and second shoulder straps.

10. The fishing vest of claim 9 further comprising a torso strap releasably attached to end portions of said chest pack.

11. The fishing vest of claim 1 wherein said securement means comprises a neck harness attached to said first shoulder strap and said second shoulder strap and extending behind the wearer's neck to retain said shoulder straps in place.

12. The fishing vest of claim 1 wherein said securement means comprises at least one back panel which interconnects with said at least one front storage compartment and underlies at least a portion of said first and second shoulder straps.

* * * * *